US012612842B2

(12) United States Patent
Shaw

(10) Patent No.: US 12,612,842 B2
(45) Date of Patent: Apr. 28, 2026

(54) MULTIPLE CIRCUMFERENTIAL ACTUATORS FOR ACTUATING DOWNHOLE VALVES

(71) Applicant: Silverwell Technology Ltd, Histon (GB)

(72) Inventor: Joel David Shaw, Houston, TX (US)

(73) Assignee: Silverwell Technology Limited, Cambridge (GB)

( * ) Notice: Subject to any disclaimer, the term of this patent is extended or adjusted under 35 U.S.C. 154(b) by 0 days.

(21) Appl. No.: 18/910,859

(22) Filed: Oct. 9, 2024

(65) Prior Publication Data

US 2025/0122778 A1 Apr. 17, 2025

Related U.S. Application Data

(60) Provisional application No. 63/589,825, filed on Oct. 12, 2023.

(51) Int. Cl.
*E21B 34/06* (2006.01)

(52) U.S. Cl.
CPC ..... *E21B 34/066* (2013.01)

(58) Field of Classification Search
CPC ..... E21B 34/066
See application file for complete search history.

(56) References Cited

U.S. PATENT DOCUMENTS

| | | | |
|---|---|---|---|
| 5,309,988 | A | 5/1994 | Shy et al. |
| 6,237,683 | B1 | 5/2001 | Pringle et al. |
| 8,464,799 | B2 | 6/2013 | Scott et al. |
| 8,757,265 | B1 | 6/2014 | Cuffe et al. |
| 9,051,810 | B1 | 6/2015 | Cuffe et al. |
| 10,156,124 | B2 | 12/2018 | Guzman et al. |
| 10,208,568 | B2 | 2/2019 | Hill et al. |
| 10,253,594 | B2 | 4/2019 | Wakefield et al. |
| 10,301,908 | B2 | 5/2019 | Wakefield et al. |
| 11,306,561 | B2 | 4/2022 | Franklin et al. |
| 11,346,183 | B2 | 5/2022 | Mair et al. |
| 2015/0129197 | A1 | 5/2015 | Andreychuk et al. |
| 2023/0313640 | A1 | 10/2023 | Hofacker et al. |

OTHER PUBLICATIONS

International Search Report and Written Opinion for PCT Application No. PCT/GB2024/052621 dated Dec. 9, 2024.

*Primary Examiner* — Taras P Bemko
(74) *Attorney, Agent, or Firm* — Bracewell LLP; Keith R. Derrington

(57) ABSTRACT

A valve system controls flow into a downhole production string, and which includes a downhole valve with a port formed in a sidewall of a production string disposed in a wellbore, and a sleeve that is slidable along the production string to block or allow flow through the port. An actuator assembly exerts a sliding force onto the sleeve, and is made up of multiple actuators arranged along an outer surface of the production string. Each actuator has an electrically powered motor and a stem connected to the motor. An opposite end of each stem connects to an end of the sleeve. Energizing the motors causes linear movement of the stems and connected sleeve to open and close the valve.

15 Claims, 4 Drawing Sheets

MULTIPLE CIRCUMFERENTIAL ACTUATORS FOR ACTUATING DOWNHOLE VALVES

CROSS-REFERENCE TO RELATED APPLICATIONS

This application claims priority to and the benefit of co-pending U.S. Provisional Application Ser. No. 63/589,825, filed Oct. 12, 2023, the full disclosure of which is incorporated by reference herein in its entirety and for all purposes.

BACKGROUND OF THE INVENTION

1. Field of Invention

The present disclosure relates to actuating a downhole valve with multiple actuators that are circumferentially arranged.

2. Description of Prior Art

Well systems for delivering fluids to surface that have been extracted from subterranean formations typically include a wellbore formed into the formation and a flow circuit inserted within the wellbore. The flow circuit is generally made up of production tubing, and occasionally includes a well completion component (e.g., gravel pack, screens, etc.). The produced fluid usually enters the flow circuit through a port or ports formed through sidewalls of the production tubing or well completion component. Fluid inside the flow circuit flows uphole to surface, where it is collected or directed offsite for processing. In some situations, fluid is introduced into the flow circuit on surface and forced downhole, where the fluid is discharged from the ports and injected into the formation.

Valves systems are often included with the flow circuits downhole, and are used for regulating or controlling fluid flow through the ports or as safety valves for blocking fluid flow inside the flow circuits. Other uses include fluid injection into the reservoir, production from the reservoir, and to allow communication between the tubing and annulus. One type of valve system includes a sleeve that circumscribes a portion of the flow circuit adjacent a port, and that is moved with respect to the port to block or allow flow through all or a portion of the port. Actuators for sliding these sleeves are typically hydraulically powered. However, it is difficult to accurately position a downhole valve using hydraulic actuation, which is a limitation of functionality. Another drawback of hydraulic actuation is that the multiple hydraulic lines introduce complication during installation.

SUMMARY OF THE INVENTION

Disclosed herein is an example of a valve system for use with a production string in a wellbore that includes electrically powered actuator assemblies mounted on the production string and having a combined output force, and a sleeve coupled to the electrically powered actuator assemblies and selectively slideable along the production string in response to the combined output force, the sleeve having an outer diameter being radially past outer surfaces of the electrically powered actuator assemblies. Examples of the actuator assemblies include a motor and a stem connected between the motor and the sleeve, and in alternatives includes a compliant member between each of the motors and stems for correcting asynchronous motor operation. The valve system optionally includes a controller for synchronizing operation of the actuator assemblies. Examples of the valve system include the actuator assemblies being symmetrically or asymmetrically spaced around an axis of the production string. In an example, the sleeve circumscribes an outer surface of the production string. In an embodiment, the sleeve is selectively moveable to a closed position where the sleeve is radially outward from an entire cross section of the port to block fluid communication from a bore of the production string to an annulus that circumscribes the production string, or selectively moveable axially along the production string to away from at least a portion of the cross section of the port to block fluid communication from a bore of the production string to an annulus that circumscribes the production string.

Also disclosed is an example method of operating a valve system in a production string in a wellbore, which includes axially positioning a sleeve that circumscribes a portion of the production string by selectively operating actuators on the production string that exert a force onto the sleeve, which is distributed about an axis of the sleeve. The method optionally includes synchronizing the actuators, which in one example, the step of synchronizing includes controlling motors in the actuators so that outputs of the actuators are substantially the same, and includes one or more of evaluating variance from an anticipated performance by monitoring feedback of current or voltage being delivered to or consumed by motors or evaluating variance from an anticipated performance by monitoring position of the stems. In an alternative, outputs of the actuators include velocity, a force, and combinations. In alternatives, controlling the motors includes adjusting operation of the motors so that an actual performance of the motors is substantially the same as an anticipated performance. In one embodiment, a motor or motors having an actual performance different from an expected performance defines a non-complying motor or motors, and a motor or motors having an actual performance substantially the same as an expected performance defines a complying motor or motors, and where the motors are controlled by adjusting operation of the complying motor or motors so that performance of the complying motor or motors is substantially the same as the non-complying motor or motors. An outer diameter of the sleeve optionally projects radially past an outer surface of the actuators. Examples of the actuators includes motors, a stem attached to an output of each of the motors, and compliant members between each motor and attached stem for correcting asynchronous operation of the motor.

BRIEF DESCRIPTION OF DRAWINGS

Some of the features and benefits of the present invention having been stated, others will become apparent as the description proceeds when taken in conjunction with the accompanying drawings, in which.

Figure 1:
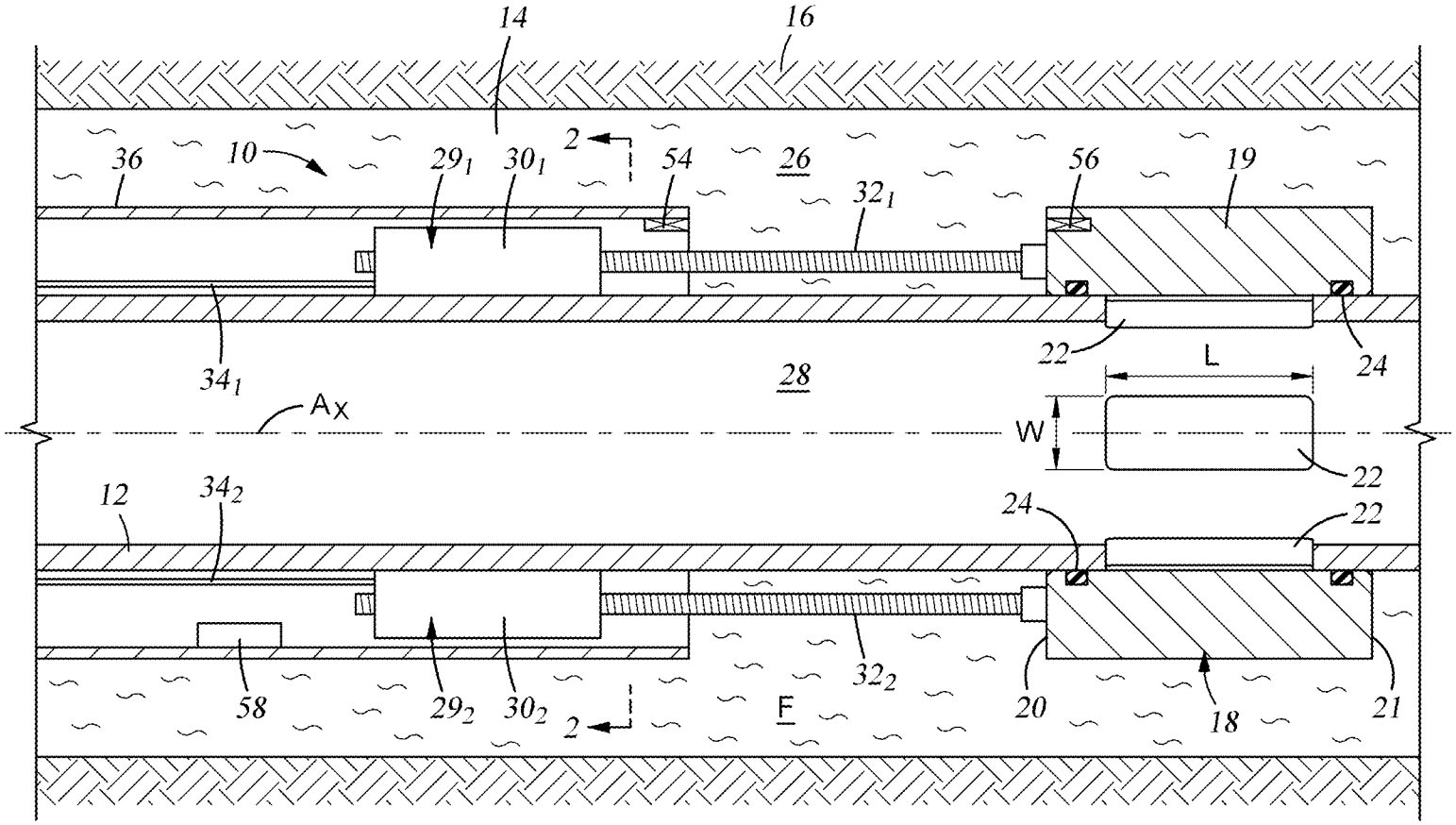
FIG. 1 is a side partial sectional view of an example of a downhole valve assembly with circumferential actuators.

While subject matter is described in connection with embodiments disclosed herein, it will be understood that the scope of the present disclosure is not limited to any particular embodiment. On the contrary, it is intended to cover all alternatives, modifications, and equivalents thereof.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

The valve system disclosed herein includes an actuator with an increased shifting force, which is an all-electric downhole system that provides for increased flow area through production tubing, and minimizes the outer diameter for placement into smaller casing. The system includes multiple smaller diameter actuators placed circumferentially around the tool that act in conjunction with each other. This allows the actuators to better fit withing the diametrical constraints of the tool that is being actuated.

FIG. 1 is a partial side sectional view of an example of a valve system 10 for controlling flow into and out of a production string 12, which is shown inserted into a portion of a wellbore 14 formed within a formation 16. A valve 18 is included with valve system 10, valve 18 is made up of an annular sleeve 19 having a forward end 20 and an aft end 21, and that circumscribes a portion of the production string 12. The valve 18 also includes ports 22 that penetrate through the sidewalls of production string 12 at various azimuthal locations about the production string 12. Ports 22 are shown having generally rectangular shapes with opposing axial ends that are spaced apart by a length L and opposing lateral ends spaced apart by a width W. Lengths L are oriented generally parallel with axis $A_X$ and widths W are oriented along a circumference of production string 12; and where dimensions of the lengths L exceed dimensions of the widths W, embodiments exist in which dimensions of the widths W are substantially equal to or greater than dimensions of the lengths L. As shown, the ports 22 are shown disposed at substantially the same axial location along the production string 12, generally distributed about the production string 12 equidistant from one another, and have substantially the same lengths L and widths W. The ports 22 optionally are staggered at different axial locations along the production string 12, staggered at different distances from one another about the circumference of the production string 12, have different dimensions, different shapes, and combinations of these. Alternatives of the valve 18 include an interval control valve for allowing fluid F from a portion of formation 16 into production string 12, a safety valve that acts as a barrier to flow in certain operating scenarios (such as an upset condition), or a control valve for regulating flow through the valve 18 to be at a designated rate. In the example of FIG. 1, sleeve 19 is positioned so that its forward and aft ends 20, 21 are respectively located on opposite sides of opposing axial ends of ports 22, which places valve 18 is in a closed configuration. When in the closed configuration, valve 18 defines a barrier to fluid communication between ports 22 and an annular space 26, where annular space 26 is between production string 12 and sidewalls of wellbore 14. When in the closed configuration, valve 18 blocks fluid F in annular space 26 from entering a bore 28 of production string 12. Optional O-rings 24 are included between the sleeve 19 and production string 12 to avoid leakage through valve 18. As described in more detail below, the fluid F is extracted from formation 16, flows into bore 28 when valve 18 is in an open configuration, once inside bore 28, the fluid F is directed to surface within production string 12. For the purposes of discussion herein, a percent open of valve 18 is defined by what percentage of the entire cross-sectional area of the ports 22 is not circumscribed by the sleeve 19, i.e., is in direct communication with the annulus 26, so that there is path for fluid communication between the bore 28 and the annulus 26 through that portion of the ports 22. A designated percent open is a percent open of the valve 18 at which a designated flowrate of fluid flows through the valve 18. Alternate embodiments exist in which some or all of ports 22 are triangularly shaped, and in examples the triangularly shaped ports are oriented so that their apexes are proximate the aft end 21 of the sleeve 19 when the valve 18 is in the closed configuration. Further embodiments exist in which at least some ports are discrete members of different sizes and strategically located along the production string 12 so that a per unit displacement of the sleeve 19 axially along some portions of the production string 12 causes a greater change of cross-sectional area of communication between the bore 28 and annulus 26 than a per unit displacement of the sleeve 19 axially along other portions of the production string 12.

Valve system 10 also includes actuator assemblies $\mathbf{29}_{1,2}$ that exert a force onto to slide sleeve 19 along the outer surface of production string 12 with respect to ports 22. Fluid communication between bore 28 and annulus 26 is provided by sliding sleeve 19 a distance so that all or a portion of sleeve 19 is no longer between ports 22 and annulus 26. In the example shown, actuator assemblies $\mathbf{29}_{1,2}$ include motors $\mathbf{30}_{1,2}$ and stems $\mathbf{32}_{1,2}$ that each have an end connected to one of the motors $\mathbf{30}_{1,2}$, and an opposite end connected to sleeve 19. The stems $\mathbf{32}_{1,2}$ extend along axis $A_X$ and are at circumferentially spaced apart locations about axis $A_X$. Lines $\mathbf{34}_{1,2}$ are shown connected to an end of each of the motors $\mathbf{30}_{1,2}$ for providing electricity to the motors $\mathbf{30}_{1,2}$. In alternatives, lines $\mathbf{34}_{1,2}$ further provide a source of signal communication to and from motors $\mathbf{30}_{1,2}$ for controlling operation of motors $\mathbf{30}_{1,2}$, and monitoring conditions of motors $\mathbf{30}_{1,2}$. Example conditions of motors $\mathbf{30}_{1,2}$ include electrical power consumption, temperature, and position of stems $\mathbf{32}_{1,2}$. An optional housing 36 is shown covering motors $\mathbf{30}_{1,2}$ and a portion of stems $\mathbf{32}_{1,2}$. In alternatives, a gear assembly (not shown), such as a gear train, is coupled between an output of one or more of motors $\mathbf{30}_{1,2}$ and stems $\mathbf{32}_{1,2}$, which in examples adjusts output torque from motors $\mathbf{30}_{1,2}$ to a designated torque that is exerted onto stems $\mathbf{32}_{1,2}$, adjusts a rate of rotational and/or linear velocity at an output of motors $\mathbf{30}_{1,2}$ to rotate stems $\mathbf{32}_{1,2}$ at a designated rate of rotation and/or cause movement of stems $\mathbf{32}_{1,2}$ at a designated linear velocity. Examples of gear assembly include devices, such as a worm gear, ball screw, and the like, and combinations, that convert a rotary output motion from motors $30_{1,2}$ to a linear motion.

Figure 2:
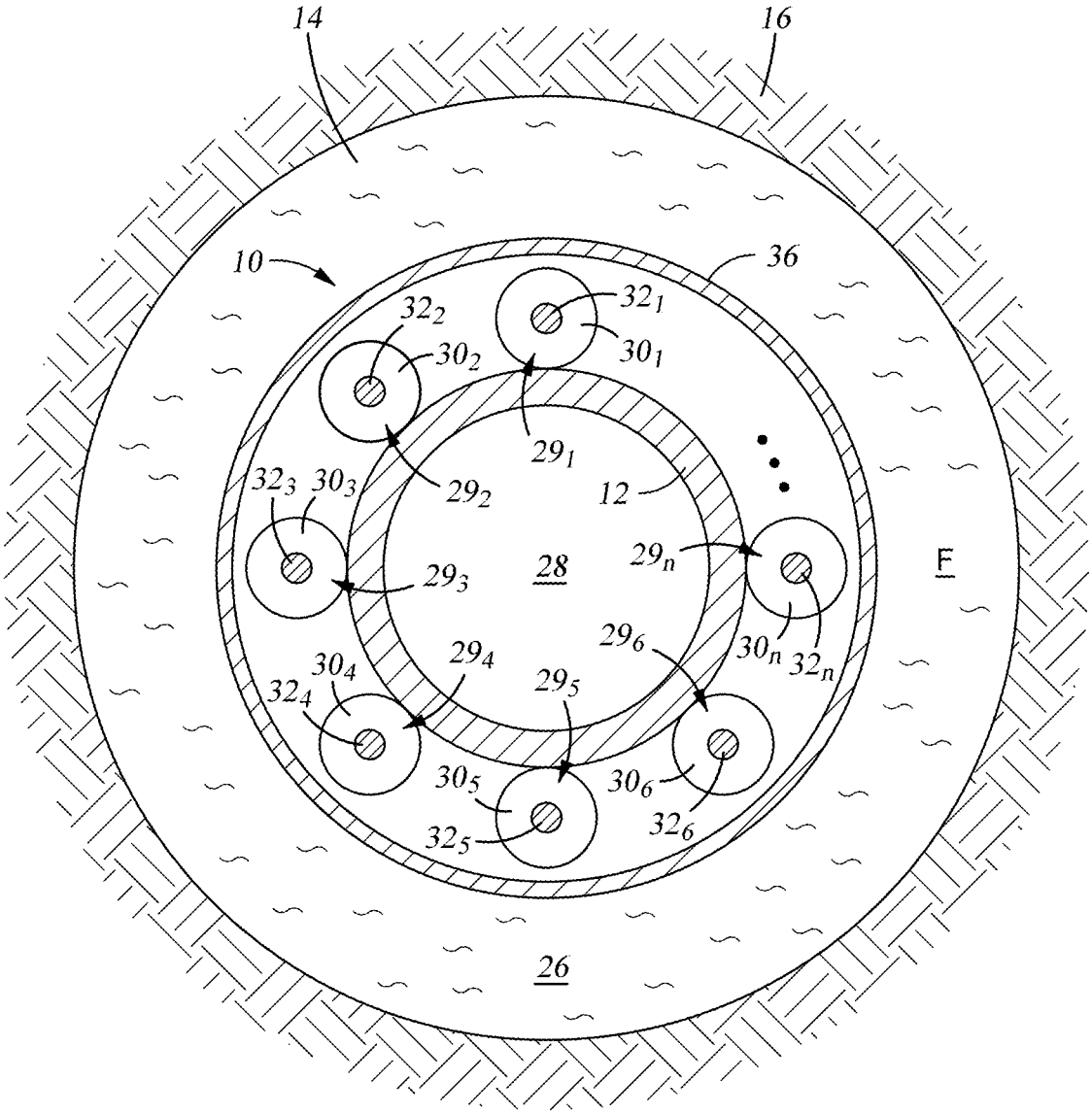
FIG. 2 is an axial sectional view of the downhole valve assembly of FIG. 1 and taken along lines 2-2.

Referring now to FIG. 2, shown in an axial view is an example of a portion of the valve system 10 taken along lines 2-2. In this example valve system 10 has a plurality of actuator assemblies $29_{1-n}$ that are spaced asymmetrically about axis $A_X$ of the production string 12; which include motors $30_{1-n}$ and connected stems $32_{1-n}$. Illustrated in the example of FIG. 2 is that embodiments exist in which the quantity of the actuator assemblies $29_{1-n}$ exceeds two as shown in FIG. 1, and is adaptable to different designs and configurations and applications within a wellbore. In alternatives, the plurality of actuator assemblies $29_{1-n}$ are spaced symmetrically about axis $A_X$.

Figure 3:
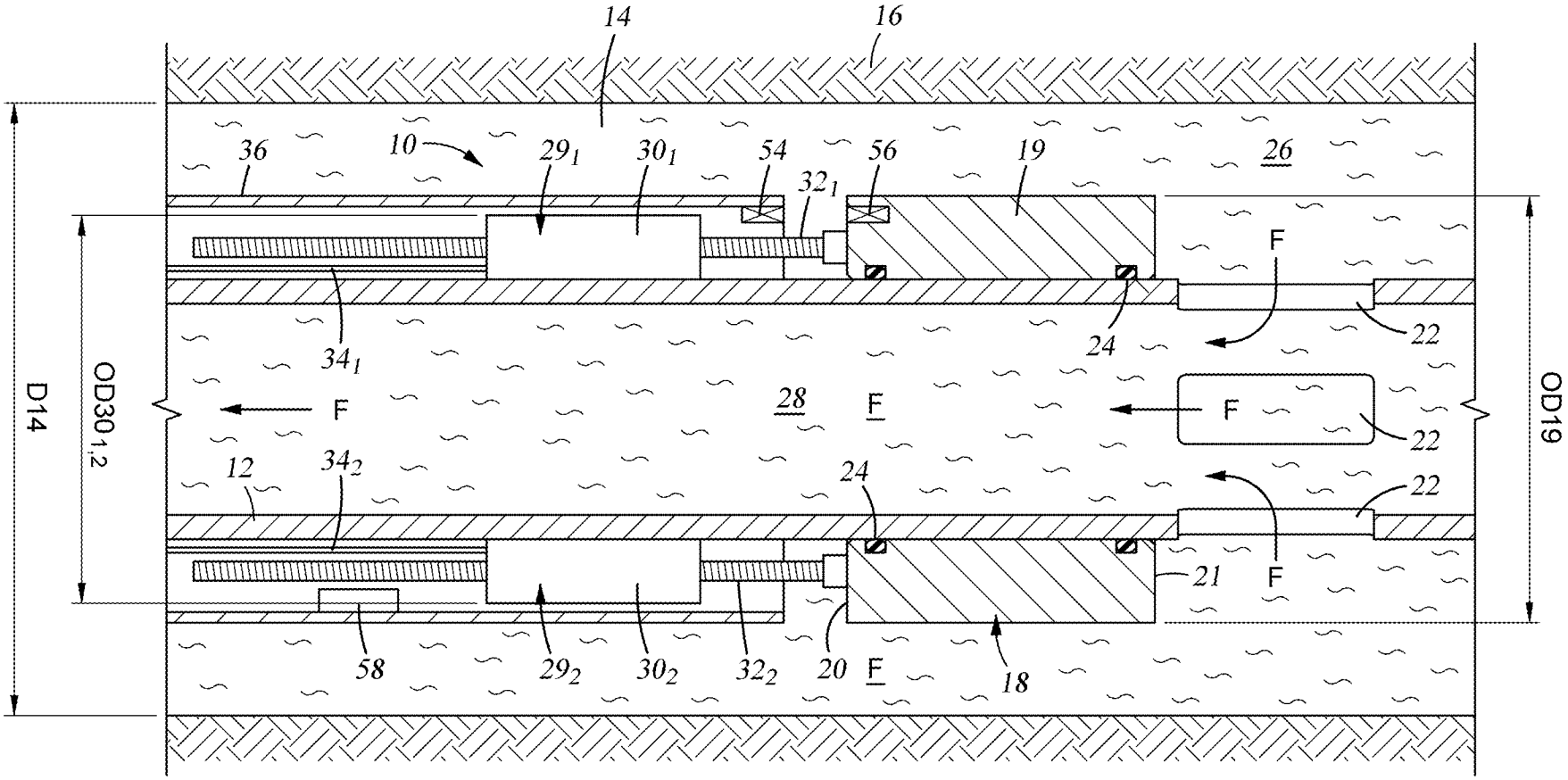
FIG. 3 is a side partial sectional view of the downhole valve assembly of FIG. 1 in an open configuration.

FIG. 3 is a side sectional view of an example of the valve system 10 in an open configuration, and unlike in the closed configuration of FIG. 1, communication exists between the bore 28 of production string 12 and annular space 26. In this example, greater portions of stems $32_{1,2}$ are shown within housing 36 after having been retracted from their extended configuration of FIG. 1, and by their connection to sleeve 19, retracting the stems $32_{1,2}$ moves sleeve 19 axially away from its location of FIG. 1, which circumscribes ports 22 and blocks communication between bore 28 and annulus 26, to a location that is spaced axially adjacent or away from ports 22. In alternatives, sleeve 19 is moved to a location so that a part of sleeve 19 circumscribes ports 22 to block a portion of the cross-sectional area of ports 22, and bore 28, from direct communication with the annulus 26. An advantage of actuator assemblies $29_{1,2}$ with electrically powered motors $30_{1,2}$ is the ability to control movement of stems $32_{1,2}$ to discrete increments of distance to move sleeve 19 precisely to a designated operating position so that fluid F flows through valve 18 at a designated flowrate. Embodiments exist in which the designated flowrate varies with different operating scenarios. Examples of the designated operation position of the sleeve 19 include the sleeve 19 being positioned radially outward from the entireties of ports 22 and fully circumscribing ports 22 (FIG. 1) so that the valve 18 is in the closed configuration, the sleeve 19 being positioned so that none of the sleeve 19 is located radially outward from any portion of ports 22 (FIG. 3) so that the valve 18 is in the fully open configuration, and the sleeve 19 being positioned so that the sleeve 19 is located radially outward from a portion or portions of ports 22 so that the percent open of the valve 18 is less than 100%, which is referred to herein as a partially open or variable choking configuration. The designated operating position and values of the designated flowrate are determinable by one skilled in the art. Accurately and precisely positioning sleeve 19 at the designated operating position allows for control of a particular flow rate of fluid F flowing through the ports 22 and within bore 28 of production string 12. Alternatives exist in which the motors $30_{1,2}$ are controlled to have a force output so that the force exerted onto sleeve 19 by stems $32_{1,2}$ varies at different stages of movement of sleeve 19, i.e., greater when initiating movement of sleeve 19 (to overcome inertia and static friction) than when continuing movement of sleeve 19, and reduces when sleeve 19 is approaching a designated location. For the purposes of discussion herein, a designated location is a position of sleeve 19 so that the valve 18 is in a designated configuration, e.g., closed configuration, fully open configuration, and a particular or designated percent open.

Figure 4:
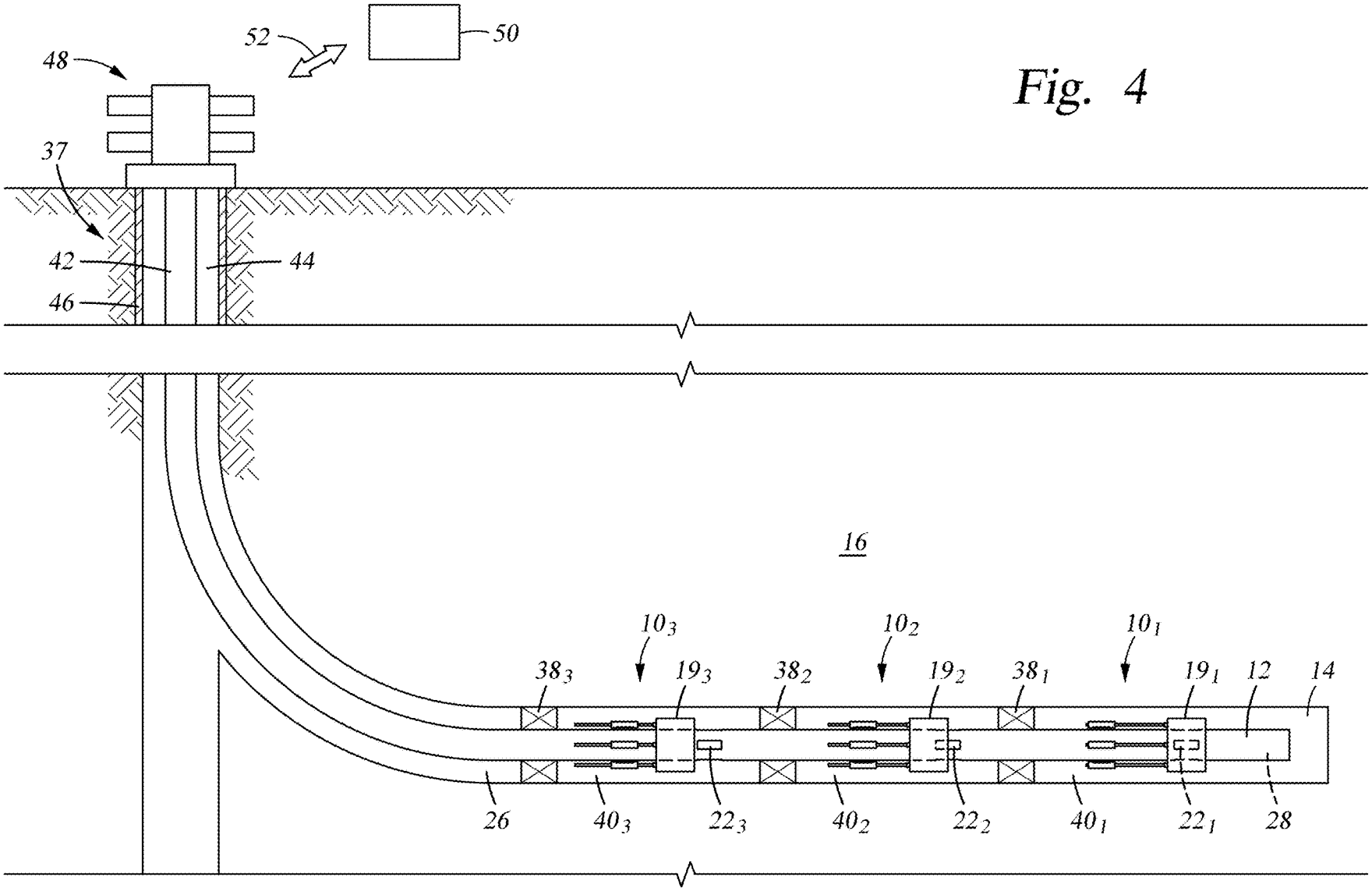
FIG. 4 is a side partial sectional view of a wellbore system having a lateral portion with multiple downhole valve assemblies of FIG. 1 installed within.

Shown in a side sectional view in FIG. 4 is an example of a well circuit 37 having multiple valve systems $10_{1-3}$ within the wellbore 14. As shown, wellbore 14 is a lateral or side wellbore. In this example, packers $38_{1-3}$ are disposed within the annulus 26 between the production string 12 and sidewalls of the wellbore 14; defined between the packers $38_{1-3}$ are compartments $40_{1-3}$ that are dedicated to each of the individual valve systems $10_{1-3}$. An advantage of the compartmentalization, as illustrated in the example of FIG. 4, is that flow of fluid F into the production string 12 from a specific one of the compartments $40_{1-3}$ is controllable by selective actuation of actuator assembly $29_{1-3}$ of the valve systems $10_{1-3}$. As illustrated, valve systems $10_1$, $10_3$ are shown in a closed configuration, which blocks flow of fluid F from compartments $40_1$ and $40_3$ into production string 12. In contrast, the valve system $10_2$ is shown in an open configuration with sleeve $19_2$ spaced axially away from at least a portion of ports $22_2$, which allows fluid F within compartment $40_2$ of annulus 26 to flow from anulus 26 into production string 12. From production string 12, fluid F is directed to a main production string 42 which is disposed in a mother bore 44; which along with wellbore 14 is a part of well circuit 37. Casing 46 is optionally included shown lining the sidewalls of mother bore 44. In alternatives, casing (not shown) also lines sidewalls of wellbore 14, less than or more than three valve systems are provided on a length of production string, and ports are uphole of motors. Further illustrated in this example is a wellhead assembly 48 mounted on an upper end of mother bore 44 for controlling flow and/or pressure within well system 37. A controller 50 is shown schematically on surface and in communication with wellbore circuit 37 via communication means 52. In non-limiting examples, communication means 52 includes wireless as well as hardwire or fiber optic connections. In a further alternative, logics are included within controller 50.

Referring back to FIGS. 1 and 3, a sensor 54 is optionally included within housing 36 and a proximity tag 56 is disposed within or on sleeve 19. In the example of FIG. 3 sleeve 19 is moved adjacent housing 36 by operation of actuator assemblies $29_{1,2}$ to move valve assembly 18 into an open configuration, and also moves proximity tag 56 closer to sensor 54 than when in the closed configuration of FIG. 1. A signal from sensor 54 represents a distance between sensor 54 and tag 56, which in turn provides a location of sleeve 19 with respect to ports 22. The location of sleeve 19 with respect to ports 22 provides information to determine the configuration of the valve assembly (i.e., open or closed), and when the valve is partially open, what percentage of the cross sectional area of the ports 22 being covered by the sleeve 19. Further optionally illustrated in FIGS. 1 and 3 is a local controller 58 for controlling operation of the individual actuator assemblies $29_{1,2}$. In alternatives, controller 58 is in communication with control unit 50 on surface via communication means 52 so that knowledge of valve system 10 configurations are known on surface and for correlating flows to surface. In embodiments, local controller 58 is in communication with one or more of the motors $30_{1,2}$ via lines $34_{1,2}$.

In a nonlimiting example of operation of valve system 10 of FIGS. 1-3, or valve systems $10_{1-3}$ of FIG. 4, operations personnel identify the designated flowrate of fluid F through valve system 10, or flowrates through valve systems $10_{1-3}$ and obtain the designated operating position of sleeve 19 based on the designated flowrate or flowrates. The designated operating position of sleeve 19, or sleeves (FIG. 4), is compared with a current position of sleeve 19, such as by analyzing a signal from sensor 54 (FIG. 3). Further in this example, if the current position of sleeve 19 is spatially offset from the designated operating position, sleeve 19 is repositioned to the designated operating position by activation of one or more of assemblies $29_{1,2}$ (FIG. 3) or assemblies $29_{1-n}$ (FIG. 2), where an example of activation includes transmitting electricity to assemblies $29_{1,2}$ and/or assemblies $29_{1-n}$ via lines 34. Optionally, control unit 50 and/or controller 58 are configured to send instructions to actuator assemblies $29_{1,2}$ to automatically position and reposition sleeve 19 to the designated operating position (e.g., fully open, fully closed, at a designated percent open); where examples include instructions accessible by control unit 50 and/or controller 58 for the control of the actuator assemblies $29_{1,2}$.

Embodiments of motors $30_{1-n}$ for use with the actuator assemblies $29_{1-n}$ include brushless DC motors, brushed motors, rotary type, linear type, and combinations. An advantage provided by employing multiple electrical actuators rather than a single electrical actuator is that greater shifting forces are achieved with a smaller overall diametrical footprint. The smaller profile is illustrated in FIG. 3 by an outer diameter OD19 of the sleeve 19 exceeding an outer diameter OD$30_{1,2}$ defined by outermost radial surfaces of motors $30_{1,2}$ mounted on the production tubing 12. Unlike a single actuator, using multiple motors $30_{1,2}$ with profiles less than the sleeve 19 does not increase the overall profile of the production string 12 and allows for use of larger diameter production strings, and avoids the problems of insufficient clearance when there are small differences between the diameter $D_{14}$ of wellbore 14 and the outer diameter $OD_{19}$ of sleeve 19. The actuator assemblies $29_{1-n}$ that are mounted at multiple locations circumferentially about the outer surface of the production string 12 exert a combined force to the sleeve 19 that is distributed along the circumference of the sleeve 19, whereas a single actuator would apply a force at a single azimuthal location that could apply an eccentric load to cause binding of the sleeve 19. Alternatively, an output force exerted by an individual one of the actuator assemblies $29_{1-n}$ is less than the force at which initiates or perpetuates sliding of sleeve 19 along production string 12, and a combined force from the actuator assemblies $29_{1-n}$ is equal to or greater than the force urges sleeve 19 along production string 12, either from rest or while in motion.

Options for balancing forces exerted onto the sleeve 19 include synchronizing the actuator assemblies $29_{1-n}$. Examples of the actuator assemblies $29_{1-n}$ being synchronized, or being in sync, include the motors $30_{1-n}$ operating so that the stems $32_{1-n}$ each move at substantially the same velocity and/or exert substantially the same force onto the sleeve 19. Synchronizing the actuator assemblies $29_{1-n}$ provides an advantage of the force being exerted onto the sleeve 19 being distributed substantially equally about a circumference of the sleeve 19, which avoids binding and other similar obstacles to ready movement created by an asymmetric load being applied to the sleeve 19. For the purposes of discussion herein, an expected operation of actuator assemblies $29_{1-n}$ defines an anticipated performance of each of the assemblies $29_{1-n}$, e.g., output velocity, and/or output force of motors $30_{1-n}$, such as when a given amount of electricity is being supplied to the assemblies $29_{1-n}$. In a nonlimiting example of operation, actuator assemblies $29_{1-n}$ are controlled so that if the performance of one or more of the actuator assemblies $29_{1-n}$ varies from an anticipated performance, the supply of electricity to the out of performance actuator assembly is adjusted so that its actual performance matches it anticipated performance so that movements of each of the actuator assemblies $29_{1-n}$ are synchronized with one another. An example of evaluating variance from an anticipated performance includes monitoring feedback of current or voltage being delivered to or consumed by motors $30_{1-n}$ and/or position of a particular one or more of the stems $32_{1-n}$, and depending on the feedback, the signal or electrical power driving a particular one of motors $30_{1-n}$ coupled with the one or more of the stems $32_{1-n}$, is appropriately adjusted to synchronize the actuator assemblies $29_{1-n}$. In an alternate embodiment, adjustments are made to operation of actuator assemblies $29_{1-n}$ performing as expected to synchronize them with one or more of actuator assemblies $29_{1-n}$ that are not operating as expected. In examples, artificial intelligence and/or machine learning is used to identify or predict anomalies encountered when shifting sleeve 19 to a designated location, and for correcting anomalies. Further optionally is the use of compliance to compensate for asynchronous operation of different motors $30_{1-n}$ so that output of actuator assemblies $29_{1-n}$ remains substantially the same, such as placement of resilient members (not shown) between each stem $32_{1-n}$ and the sleeve 19, example resilient members include springs, Belleville washers, cantilever springs, hydraulically interconnected pistons, and shims.

As a greater force is required to initiate movement of the sleeve 19 (starting force) over that required for continuing movement of the sleeve 19 (moving force); in a further embodiment, actuator assemblies $29_{1-n}$ are controlled to exert a lower magnitude of force on sleeve 19 when the sleeve 19 is in motion than when the sleeve 19 is at rest. An advantage of reducing the applied force after the sleeve 19 is in motion allows for greater precision when putting the sleeve 19 in the designated position. In an embodiment, combining output forces from actuator assemblies $29_{1-n}$ generates a combined force that exceeds starting force and moving force, whereas an output force from an individual actuator assembly is less than either of starting force or moving force.

In examples, controller 58 (FIG. 1) and/or control unit 50 (FIG. 4) include a master node processor and memory coupled to the processor to store operating instructions, control information and database records therein. A multicore processor with nodes such as those from Intel Corporation or Advanced Micro Devices (AMD), or an HPC Linux cluster computer is optionally included with or in communication with controller 58 and/or control unit 50. In an example, the control unit 50 is a mainframe computer of any conventional type of suitable processing capacity such as those available from International Business Machines (IBM) of Armonk, N.Y. or other source or a computer of any conventional type of suitable processing capacity, such as a personal computer, laptop computer, or any other suitable processing apparatus. It should thus be understood that a number of commercially available data processing systems and types of computers may be used for this purpose. The controller 58 and/or control unit 50 are optionally accessible to operators or users through a user interface for displaying output data or records of processing results obtained according to the present disclosure with an output graphic user display, which includes components such as a printer and an output display screen capable of providing printed output information or visible displays in the form of graphs, data sheets, graphical images, data plots and the like as output records or images. The user interface also optionally includes a suitable user input device or input/output control unit to provide a user access to control or access information and database records and operate a computer associated with controller 58 and/or control unit 50. In examples, included with controller 58 and/or control unit 50 is a database of data stored in computer memory, such as internal memory, or an external, networked, or non-networked memory in an associated database in a server. The controller 58 and/or control unit 50 optionally include executable code stored in non-transitory memory. The executable code according to the present disclosure is in the form of computer operable instructions the implement some or all elements of the process and cause the data processor to determine operations according to the present disclosure. It should be noted that executable code may be in the form of microcode, programs, routines, or symbolic computer operable languages capable of providing a specific set of ordered operations controlling the functions listed herein and direct operation of described systems. The instructions of executable code are optionally stored in memory of the controller 58 and/or control unit 50, or on computer diskette, magnetic tape, conventional hard disk drive, electronic read-only memory, optical storage device, or other appropriate data storage device having a non-transitory computer readable storage medium stored thereon. Executable code may also be contained on a data storage device such as server as a non-transitory computer readable storage medium. The controller 58 and/or control unit 50 may include a single CPU, or a computer cluster, including computer memory and other hardware to make it possible to manipulate data and obtain output data from input data. A cluster is a collection of computers, referred to as nodes, connected via a network.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. In an example, multiple actuator assemblies $\mathbf{29}_{1\text{-}n}$ are powered by a single tubing encapsulated conductor ("TEC") (not shown) that optionally provides signal communication to the actuator assemblies $\mathbf{29}_{1\text{-}n}$ and power and signal communication to gauges, sensors, controllers, and other devices downhole. In an alternative, operational velocity is increased by employing actuator assemblies $\mathbf{29}_{1\text{-}n}$ with overhauling actuators that can be back driven. These and other similar modifications will readily suggest themselves to those skilled in the art, and are intended to be encompassed within the spirit of the present invention disclosed herein and the scope of the appended claims.

What is claimed is:

1. A valve system for use with a production string in a wellbore, the valve system comprising:

electrically powered actuator assemblies mounted on the production string and having a combined output force; and a compliant member between each of the motors and stems for correcting asynchronous motor operation:

a sleeve coupled to the electrically powered actuator assemblies and selectively slideable along the production string in response to the combined output force, the sleeve having an outer diameter being radially past outer surfaces of the electrically powered actuator assemblies.

2. The valve system of claim 1, wherein the actuator assemblies each comprise a motor and a stem connected between the motor and the sleeve.

3. The valve system of claim 1, further comprising a controller for synchronizing operation of the actuator assemblies.

4. The valve system of claim 1, wherein the actuator assemblies are spaced around an axis of the production string at distances selected from the group consisting of distances so that the actuator assemblies are symmetrically spaced around the production string and distances so that the actuator assemblies are asymmetrically spaced around the production string.

5. The valve system of claim 1, wherein the sleeve circumscribes an outer surface of the production string.

6. The valve system of claim 1, wherein the sleeve is selectively moveable to a closed position where the sleeve is radially outward from an entire cross section of the port to block fluid communication from a bore of the production string to an annulus that circumscribes the production string.

7. The valve system of claim 1, wherein the sleeve is selectively moveable axially along the production string to away from at least a portion of a cross section of the port to block fluid communication from a bore of the production string to an annulus that circumscribes the production string.

8. A method of operating a valve system in a production string in a wellbore, the method comprising:

axially positioning a sleeve that circumscribes a portion of the production string by selectively operating actuators on the production string that exert an axial force onto the sleeve, which is distributed about a circumference of the sleeve;

synchronizing the actuators; and evaluating variance from an anticipated performance by monitoring feedback of current or voltage being delivered to or consumed by motors.

9. The method of claim 8, wherein the step of synchronizing includes controlling motors in the actuators so that outputs of the actuators are substantially the same.

10. The method of claim 9, wherein outputs of the actuators comprise a characteristic selected from the group consisting of a velocity, a force, and combinations.

11. The method of claim 9, wherein controlling the motors comprises adjusting operation of the motors so that an actual performance of the motors is substantially the same as an anticipated performance.

12. The method of claim 9, wherein a motor or motors having an actual performance different from an expected performance defines a non-complying motor or motors, wherein a motor or motors having an actual performance substantially the same as an expected performance defines a complying motor or motors, and wherein controlling the motors comprises adjusting operation of the complying motor or motors so that performance of the complying motor or motors is substantially the same as the non-complying motor or motors.

13. The method of claim 8, further comprising evaluating variance from an anticipated performance by monitoring position of the stems.

14. The method of claim 8, wherein an outer diameter of the sleeve projects radially past an outer surface of the actuators.

15. The method of claim 8, wherein the actuators comprise motors, a stem attached to an output of each of the motors, and compliant members between each motor and attached stem to compensate for asynchronous operation of the motor.

* * * * *